United States Patent [19]

Shah

[11] 3,966,257

[45] June 29, 1976

[54] DRIVING ARRANGEMENT FOR ROTARY MINING HEADS OF MINING MACHINES

[75] Inventor: Arvind K. Shah, Soda Springs, Idaho

[73] Assignee: Lee-Norse, Company, Charleroi, Pa.

[22] Filed: Aug. 26, 1974

[21] Appl. No.: 500,331

[52] U.S. Cl. ..... 299/76; 299/64; 299/89

[51] Int. Cl.[2] ..... E21C 27/24

[58] Field of Search ..... 299/64, 67, 76, 78, 299/75, 89; 175/319, 106

[56] References Cited

UNITED STATES PATENTS

| | | | |
|---|---|---|---|
| 1,391,626 | 9/1921 | Gilthopre | 175/106 X |
| 2,677,536 | 5/1954 | Gleeson | 299/76 |
| 2,850,272 | 9/1958 | Joy | 175/319 X |
| 2,976,027 | 3/1961 | Allimann | 175/319 X |
| 3,285,351 | 11/1966 | Caro | 175/319 X |
| 3,773,384 | 11/1973 | Anderson | 299/76 |
| 3,774,969 | 11/1973 | Lebegue | 299/76 |
| 3,848,930 | 11/1974 | Lebegue | 299/76 |

*Primary Examiner*—Ernest R. Purser
*Assistant Examiner*—William F. Pate, III
*Attorney, Agent, or Firm*—Bernard J. Murphy

[57] ABSTRACT

A mining machine of the type wherein the rotary mining head comprises at least one rotatable support carrying a plurality of cutter drums. The support is rotatably driven through a gear box including gearing connected to the support by a plurality of drive shafts, thereby providing the mining head with substantially increased power and torque, for the employed diameter of drive shaft, while also providing other described advantages. Each of the drive shafts is connected to the gearing through a clutch whereby the load is divided between the drive shafts and the shafts are automatically disconnected from the gearing in the event that the mining head encounters high resistance to its driven rotation.

10 Claims, 6 Drawing Figures

DRIVING ARRANGEMENT FOR ROTARY MINING HEADS OF MINING MACHINES

The present invention relates to driving arrangements for rotatably driving the rotary mining heads of mining machines such as, for example, employed for the mining of coal.

Conventionally, mining machines of the type employed for the mining of coal, frequently include a mining head comprising a plurality of laterally spaced apart cutter drums fixedly mounted on an elongated support or supporting shaft which longitudinally extends completely across the forward end of the machine chassis. Conventionally, also, the support of such a mining head has been rotatably driven by a driving arrangement comprising a plurality of motors each connected to the support by only a single drive shaft. It is believed, however, that such conventional driving arrangement is subject to certain disadvantages. For example, as each motor is connected to the support by only a single drive shaft, the employed drive shaft must be constructed of relatively large diameter and commensurate relatively large spacing must be provided intermediate the cutter drums between which the drive shaft projects. Moreover, the employment of only a single drive shaft for each motor necessitates the use of relatively large gearing internally of the mining head, thus greatly limiting the minimum height to which the head of such a conventional mining machine may be reduced; and such driving arrangement, of course, necessitates that the drive shafts undergo relatively great stresses during the machine operation. In addition, the driving of a single support by a plurality of separate driving motors, per se, is believed to be disadvantageous as the two driving motors are never entirely identical; and problems are encountered in their synchronization.

An object of the present invention is to provide a new and improved driving arrangement for mining machines of the beforedescribed type, which driving arrangement is particularly adapted to permit substantially increased power and torque to be transmitted to the mining head for the employed diameter of drive shaft.

Another object of the invention is to provide a new and improved driving arrangement of the type set forth which is particularly adapted to permit employment of smaller diameter drive shafts, thereby allowing closer spacing of laterally adjacent ones of the cutter drums of the mining head.

Another object is to provide a new and improved driving arrangement of the type set forth which is particularly adapted to substantially minimize the stress imposed on each drive shaft during the machine operation.

Another object is to provide a new and improved driving arrangement of the type set forth which is particularly adapted to permit substantial reduction in the size of gearing employed within the mining head, thereby permitting reduction of the overall diameter of the mining head.

Another object is to provide a new and improved driving arrangement of the type set forth wherein the mining head is rotatably driven through a plurality of drive shafts driven by the same motor.

Another object is to provide a new and improved driving arrangement of the type set forth wherein clutch means is interposed intermediate the driving motor and the drive shafts for dividing the load between the drive shafts and preventing damage to the motor from resulting in the event that the mining head encounters undesirably high resistance to its driven rotation.

Another object is to provide a new and improved driving arrangement of the type set forth which is particularly adapted to include a plurality of separate head portions rotatably driven by individual motors.

Other objects and advantages of the invention will be apparent from the following description taken in connection with the accompanying drawings wherein, as will be understood, the preferred form of the invention has been given by way of illustration only.

In accordance with the invention, a mining machine may comprise a rotary mining head, a gear box including gearing operable for rotatably driving a plurality of drive shafts, a plurality of rotatable drive shafts connected to the gearing to be rotatably driven thereby and separately drivingly connected to at least a portion of the rotary mining head for rotatably driving the mining head during their driven rotation, and input means connected to the gearing for causing the gearing to rotatably drive the plurality of drive shafts.

Referring to the drawings.

Figure 1:
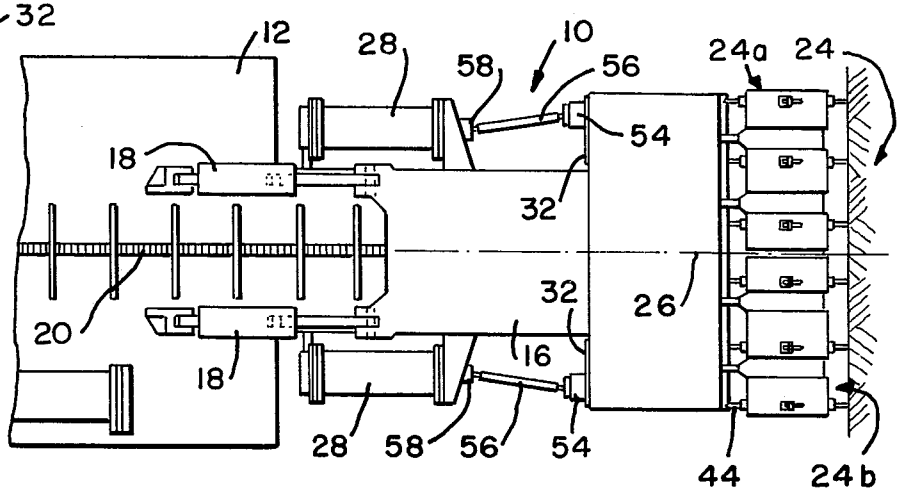
FIG. 1 is a fragmentary top or plan view illustrating the forward end of a coal mining machine including one embodiment of the invention.
Figure 2:
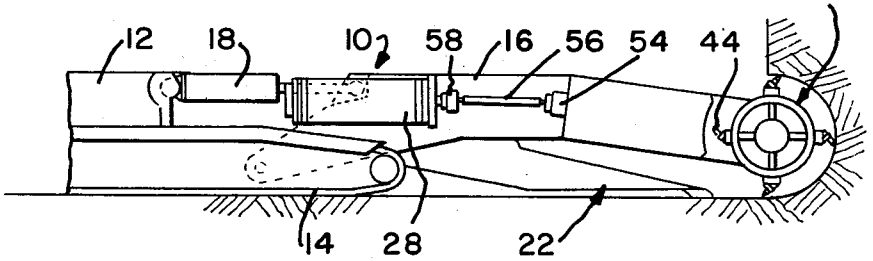
FIG. 2 is a fragmentary elevational side view of the forward end of the coal mining machine shown in FIG. 1.
Figure 4:
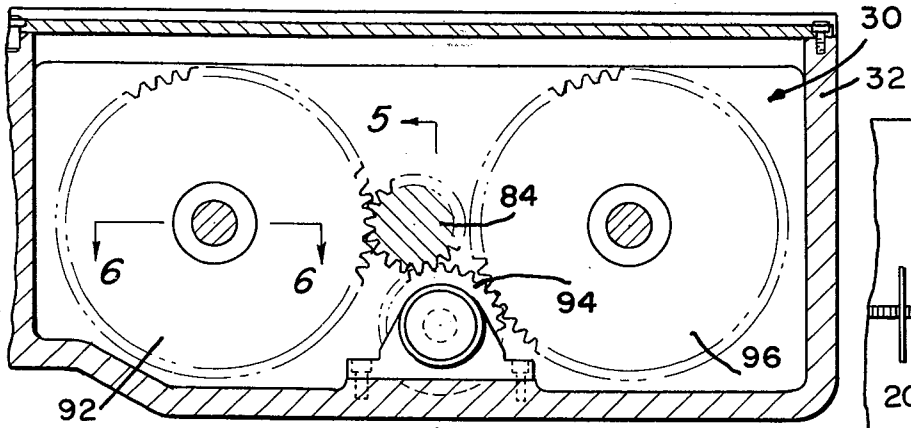
FIG. 4 is a fragmentary sectional view taken on line 4—4 of FIG. 3, looking in the direction of the arrows.

Referring more particularly to the drawings wherein similar reference characters designate corresponding parts throughout the several views, FIGS. 1 and 2 illustrate a continuous coal mining machine, designated generally as 10, comprising a mobile chassis 12, ground mounted at opposite sides by crawlers 14, and a boom 16 which is pivotally mounted to the chassis 12 for vertical movement thereto and projects forwardly of the chassis 12. The boom 16 is vertically driven relative to the chassis 12 by a pair of hydraulically operated, cylinder-and-piston actuators 18; and the usual endless conveying chain 20 extends longitudinally over the chassis 12 and projects below the boom 16 to the gathering head 22 of the machine 10. The gathering head 22, per se, may be of any suitable conventional construction and, particularly in the event that the machine 10 is intended for mining low seam coal, may be advantageously of the construction disclosed in U.S. Pat. No. 3,817,579, issued June 18, 1974 and assigned to the assignee of the present invention.

The rotary mining head of the machine 10 is designated generally as 24 and mounted on the forward end of the boom 16 to longitudinally extend transversely of the chassis 12 and boom 16. The mining head 24 includes separate, aligned, portions or sections **24*a*, 24*b* spaced apart on opposite sides of the fore-and-aft centerline 26 of the machine 10, the head portions 24***a*, 24*b* being of identical construction and arrangement and rotatably driven by separate, but identical, driving arrangements each comprising a conventional rotary output motor 28 and gear box 30. The gear boxes 30 are contained within gear housings 32 affixed to the opposite sides of the boom 16; and the motors 28 are similarly carried by opposite sides of the boom 16.

Figure 3:
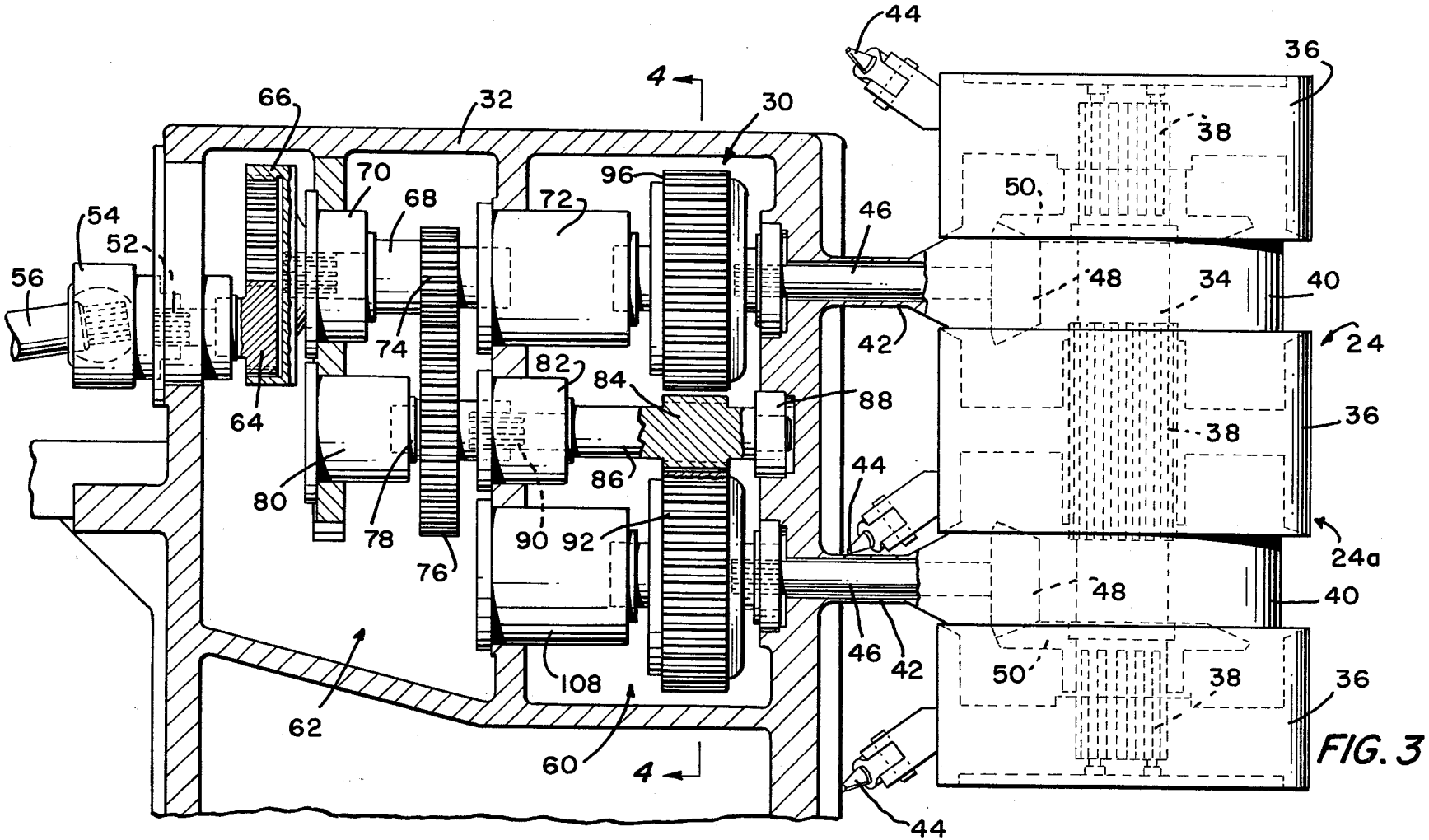
FIG. 3 is a substantially enlarged top view, partially broken away and in section, illustrating the embodiment of the invention included in the mining machine of FIGS. 1 and 2.

As best illustrated in FIG. 3 wherein the head portion 24*a* is shown for the purposes of illustration, each of the head portions 24*a*, 24*b* includes an elongated, rotatable support or supporting shaft 34 longitudinally extending transversely of the boom 16 and cutter drum means comprising a plurality of laterally spaced apart, cutter drums 36 which are affixed to the support 34 by straight splines 38 for driven rotation with the support 34 in their fixed, spaced apart positions. The support 34 is rotatably mounted on annular mounting housings 40 carried by a pair of mounting struts 42 which project intermediate laterally adjacent ones of the spaced apart cutter drums 36, the struts 42, in turn, being formed integral with the corresponding one of the gear housings 32. The cutter drums 36 carry conventional cutters 44, only a few of which are shown in the drawings for the purpose of illustration; and the supports 34 of the two drum portions 24*a*; 24*b* are aligned. The spacing between the two drum portions 24*a*, 24*b* is sufficiently small to permit the cutters 44 carried by the innermost cutter drums 36 of such portions to cut between the portions, thereby avoiding the possibility of coring between the portions 24*a*, 24*b* without any requirement for the employment of a cutter chain.

The gear box 30 for each head portion 24*a*, 24*b* is particularly adapted to be operable for rotatably driving a plurality of drive shafts and, as illustrated, connected to the support 34 of the head portion 24*a* or 24*b* through a pair of rotatable drive shafts 46. The drive shafts 46 are separately connected to the gearing of the gear box 30 and each project between laterally adjacent ones of the cutter drums 36 through one of the mounting struts 42. The drive shafts 46 each rigidly carry a drive gear 48 internally of the corresponding head portion 24*a*, 24*b* and drivingly intermeshing with a bevel gear 50 afixed to the support 34 of such head portion. The drive shafts 46 are, hence, both separately connected to the gearing of the gear box 30 to be rotatably driven through such gearing and separately connected to the support 50 for rotatably driving their respective corresponding head portion during their driven rotation through such gearing. The gear box 30 for each head portion, moreover, is particularly adapted to be driven by a single input means and provided with a single rotatable input shaft 52. The input shaft 52 is connected through a conventional universal coupling 54 to a rotatable transmission shaft 56, in turn, connected through a universal coupling 58 to be rotatably driven by the corresponding motor 28.

Each gear box 30 comprises a drive gearing section, designated generally as 60, connected to the plurality of drive shafts 46 which rotatably drive its respective corresponding head portion 24*a* or 24*b*, and also a reduction gearing section, designated generally as 62, which connects the drive gearing section 60 with the input shaft 52. In addition, the drive shafts 46 are connected to individual gears of the drive gearing section 60 through separate clutches serving to divide the load between the drive shafts 46 and also to disconnect the drive shafts 46 from the input shaft 52 (and the thereto connected motor 28) in the event that the driven head portion 24*a* or 24*b* encounters rock or other hard material presenting predetermined high resistance to its driven rotation.

More particularly, the reduction gearing system 62 of each gear box 30 comprises a first or input gear 64 affixed to the input shaft 52 for conjoined rotation therewith, and a substantially larger ring or second gear 66 surrounding and intermeshing with the first gear 64 to be rotatably driven by the latter. The ring gear 66 is affixed to one end of a shaft 68 which is rotatably supported adjacent its opposite ends by bearings carried by bearing supports 70, 72. The reduction gearing system 62 further comprises a third gear 74 affixed to the shaft 68 and a substantially larger diameter fourth gear 76, intermeshing with the third gear 74 to be rotatably driven by the latter, which is affixed to a stub shaft support 78 rotatably mounted by bearings carried by supports 80, 82.

Figure 5:
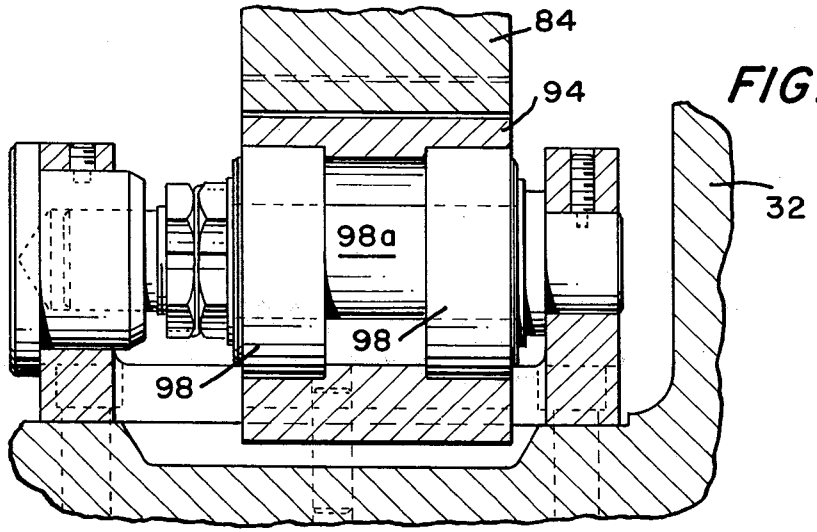
FIG. 5 is a sectional view taken on line 5—5 of FIG. 4, looking in the direction of the arrows.

The driving section 60 of each gear box 30 comprises a driving gear or clutch pinion 84 affixed on a shaft 86 which is rotatably mounted adjacent one end on the support 82 and adjacent the other end by bearings 88 carried by the gear housing 32. The shaft 86 is spline connected at 90 to the stub shaft support 78 for the gear 76 to be rotatably driven by such support 78 throughout the driven rotation of the gear 76. The driving gear 84 drivingly intermeshes with a drive or clutch gear 92 which is connected to one of the drive shafts 46 in a manner to be hereinafter described, and also drivingly intermeshes with an intermediate driving or idler gear 94, in turn, drivingly intermeshing with a drive or clutch gear 96 connected to the other of the drive shafts 46 in said manner to be hereinafter described. As shown in FIG. 5, the intermediate driving gear 94 is rotatably mounted by bearings 98 on a supporting shaft 98*a*.

Figure 6:
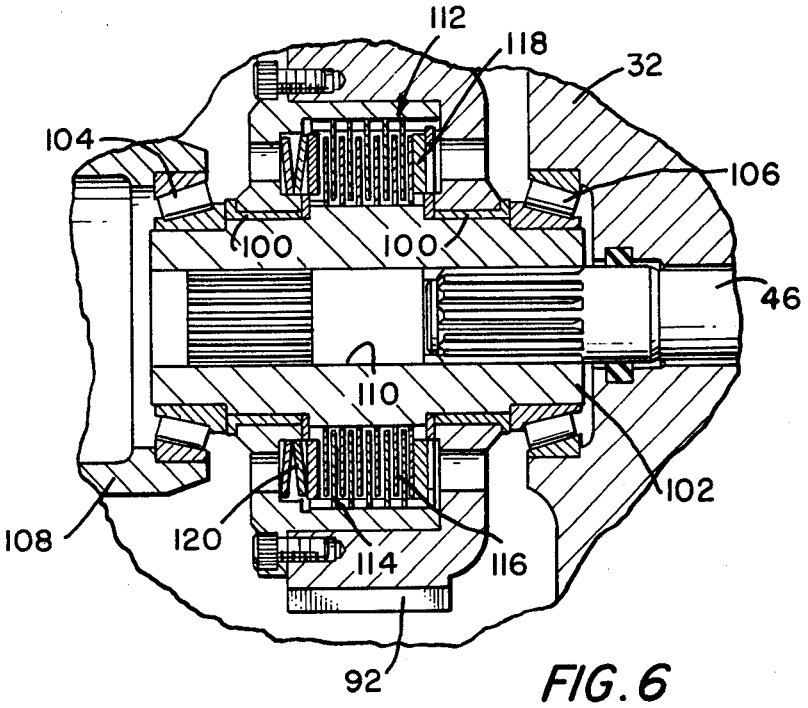
FIG. 6 is a sectional view taken on line 6—6 of FIG. 4, looking in the direction of the arrows.

The drive gears 92, 96 are separately drivingly connected to their respective drive shafts 46 in the identical manner through the beforementioned clutches. As shown in FIG. 6 wherein the connection of the drive gear 92 has been shown for the purposes of illustration, each of the drive gears 92, 96 is annular and mounted by annular bearings 100 on a supporting shaft 102 to encircle the latter, the supporting shaft 102 being, in turn, rotatably supported by bearings 104, 106 on a bearing support 108 (or, in the case of the gear 96, on the bearing support 72) and the gear housing 32. The supporting shaft 102 is provided with an axial bore 110 within which the corresponding one of the drive shafts 46 is affixed for rotation with the supporting shaft 102, the bore 110 preferably, as illustrated, containing splines adjacent each of its opposite ends whereby the supporting shaft 102 is reversible for ease of assembly. Each of the drive gears 92, 96 is normally connected to its respective supporting shaft 102 to rotatably drive the latter through a clutch designated generally as 112.

Each such clutch 112 comprises a plurality or stack of annular clutch plates 114, 116 which encircle the supporting shaft 102 and are resilently biased into face-to-face engagement with one another against an annular stop plate 118 by an annular spring 120 encircling the supporting shaft 102. The clutch plates 114 are connected to the annular gear 92 or 96 extending around the supporting shaft 102 for driven rotation with such gear; the clutch plates 116 are affixed to the supporting shaft 102. The clutch plates 114, 116 are alternately arranged in the stack and drivingly connect the supporting shaft 102 with the surrounding gear 92 or 96 in their normal face-to-face engagement, whereby the connected drive shafts 46 are normally drivingly connected to the gearing of the gear box 30 by the clutch 112 during the machine operation. The clutch plates 114, 116 are, as will be understood, laterally movable one from another against the biasing spring 120 to disconnect the drive shafts 46 from the gearing upon the driven head portion 24*a* or 24*b* encountering hard rock or other material providing high resistance to its driven rotation, and thereby prevent overstressing of the motor 28. The clutch plates 114, 116, as illustrated in FIG. 6, are shown in their latter described relationship for the purposes of illustration.

Throughout the normal operation of the mining machine 10, each of the head portions 24*a*, 24*b* is continuously rotatably driven independently of the other by its respective motor 28 through its corresponding gear box 30 and plurality of drive shafts 46. More particularly, throughout such normal operation, each motor 28 rotatably drives its respective connected shaft 56 which, in turn, rotatably drives the input shaft 52 of the corresponding gear box 30. Such rotation of the input shaft 52 causes the first gear 64 of the reduction gearing system 62 of the gear box 30 to rotatably drive the surrounding intermeshing ring gear 66 and resultantly causes the third gear 74 to rotatably drive the substantially larger fourth gear 76 of the reduction gearing system 62. Hence, the driving gear 84 is thereby rotatably driven at a reduced speed from the output of the connected motor 28 and directly rotatably drives the drive gear 92 as well as driving the drive gear 96 through the intermediate drive gear 94. As the clutch plates 114, 116 of each clutch 112 are normally held in face-to-face engagement by the spring 120 of the clutch 112, such driving of the driving gears 92, 96 normally causes commensurate driven rotation of the supports 102 for the gears 92, 96 and resultantly rotatably drives the drive shafts 46 which, in turn, act through the intermeshing gears 48, 50 to rotatably drive the support 34 and drums 36 of the connected head portion. In the event, however, the head portion encounters a predetermined high resistance to its driven rotation, such as occasioned by the cutters 44 encountering hard rock during their cutting of the coal, such causes the clutch plates 114, 116 to automatically laterally move against their biasing spring 120, thereby disengaging the clutches 112 to disconnect the supports 102 from the drive gears 92, 96 and prevent overstressing of the motor 28.

From the preceeding description, it will be seen that the employment of a plurality of drive shafts 46 for each gear box 30, rather than only a single drive shaft per gear box, substantially reduces the stress imposed on each drive shaft 46 and thereby enables each drive shaft 46 to be constructed of substantially smaller diameter for any given torque transmission from the gear box 30 to the connected head portion 24*a* or 24*b*. Hence, each drive shaft 46 may, for any given torque transmission, be constructed of substantially smaller diameter than previously to permit closer spacing of the drums 36 of each head portion 24*a* or 24*b*, thereby insuring that no coring occurs between the drums 36 of the head portion. In addition, the gears 48, 50 internally of each head portion 24*a*, 24*b* can be substantially reduced in diameter, thus enabling the construction of smaller diameter head portions 24*a*, 24*b* than previously and permitting the production of a gear driven mining head suitable for use in low coal seams. The clutches 112 divide the load between drive shafts 46 and also prevent overstressing of the motor 30 from occurring in the event that the head portion 24*a* or 24*b* encounters high predetermined resistance to its rotation. Moreover, the division of the rotary mining head into the plurality of head sections 24*a*, 24*b* eliminates the necessity for a plurality of motors to be connected to a single head, thereby avoiding the otherwise resultant potential problems.

From the preceeding description, it will be seen that the invention provides new and improved means for accomplishing all of the beforestated objects and advantages. It will be understood however that, although only a single embodiment of the invention has been illustrated and hereinbefore specifically described, the invention is not limited merely to such illustrated and described embodiment but rather contemplates other embodiments and variations within the scope of the following claims. For example, and not by way of limitation, the beforedescribed employment of a plurality of drive shafts 46 for each gear box 30 could be employed in a mining machine in which the mining head was not divided into the described plurality of portions 24*a*, 24*b*, but rather was of the conventional unitary construction.

Having thus described my invention, I claim:

1. A mining machine, comprising: a rotary mining head including at least one support rotatable about an axis, and cutter drum means carried by said support for rotation therewith, a gear box comprising gearing, a plurality of rotatable drive shafts separately and independently connected to said gearing to be rotatably driven thereby, means drivingly connecting said drive shafts to said support such that said drive shafts impart common rotary drive to said one support input means connected to said gearing for causing said gearing to drive said drive shafts; said support is disposed at a forward end of the mining machine; and said drum means extends lengthwise along said axis.

2. A mining machine according to claim 1, wherein said gear box further includes clutch means for disconnecting said drive shafts from said input means, said clutch means comprising individual clutches for said drive shafts and said clutches connecting said drive shafts to said gearing.

3. A mining machine according to claim 1, wherein said gear box is external to said cutter drum means, said gearing comprises individual drive gears for said drive shafts, and said connecting means comprises gear means separately and independently gear connecting said drive shafts to said support.

4. A mining machine according to claim 3, wherein said gear box further includes clutch means for disconnecting said drive shafts from said input means, said clutch means comprising a clutch intermediate each said drive shaft and its respective said drive gear.

5. A mining machine according to claim 1, wherein said gearing comprises individual drive gears for said drive shafts, a driving gear connected to said input means to be rotatably driven thereby and also connected to one of said drive gears to rotatably drive the latter, and an intermediate driving gear connected to said driving gear to be rotatably driven thereby and also connected to the other of said drive gears for rotatably driving the latter.

6. A mining machine according to claim 5, wherein said gear box further comprises reduction gearing means interconnecting said first mentioned driving gear with said input means.

7. A mining machine according to claim 6, further comprising clutch means connecting each of said drive shafts to its respective said drive gear and operable for disconnecting said drive shafts from said drive gears.

8. A mining machine according to claim 1, wherein said support longitudinally extends transversely to the fore-and-aft centerline of the mining machine, said cutter drum means comprises a plurality of cutter drums spaced apart along the length of said support, and said drive shafts extend between adjacent ones of said cutter drums and are gear connected to said support.

9. A mining machine according to claim 1, wherein said rotary mining head includes a second rotatable support and second cutter drum means carried by said second support for rotation therewith, and further comprising a second gear box including second gearing operable for rotatably driving a plurality of drive shafts, a plurality of second rotatable drive shafts separately and independently connected to said second gearing to be rotatably driven thereby, connecting means drivingly connecting said plurality of second drive shafts to said second support such that said plurality of second drive shafts rotatably drive said second support during their driven rotation, and second input means connected to said second gearing for causing said second gearing to rotatably drive said plurality of second drive shafts.

10. A mining machine according to claim 1, wherein said gear box further comprises reduction gearing means interconnecting said drive shafts with said input means.

* * * * *